United States Patent [19]

Power

[11] 4,441,823

[45] Apr. 10, 1984

[54] STATIC LINE MIXER

[76] Inventor: Harold H. Power, 65 Five Field Rd., Madison, Conn. 06443

[21] Appl. No.: 399,959

[22] Filed: Jul. 19, 1982

[51] Int. Cl.[3] ..... B01F 5/06

[52] U.S. Cl. ..... 366/167; 138/42; 366/340

[58] Field of Search ..... 366/340, 336, 337, 167, 366/174; 48/189.4; 138/42; 137/625.28

[56] References Cited

U.S. PATENT DOCUMENTS

| | | | |
|---|---|---|---|
| 1,924,038 | 3/1933 | Herbsman et al. | 137/111 |
| 2,802,648 | 8/1957 | Christensen et al. | 259/18 |
| 3,119,704 | 1/1964 | Harrell et al. | 366/337 X |
| 3,526,391 | 1/1967 | Church, Jr. | 259/4 |
| 3,559,958 | 2/1971 | Carpigiani | 366/336 |
| 3,582,048 | 6/1971 | Sarem | 366/340 |
| 3,582,365 | 6/1971 | Lindsey | 99/212 |
| 3,855,368 | 12/1974 | Prochazka et al. | 366/340 X |
| 3,856,270 | 12/1974 | Hemker | 259/4 |
| 3,965,975 | 6/1976 | Edmundson | 366/336 X |
| 4,025,432 | 5/1977 | Nolan et al. | 138/42 X |
| 4,068,830 | 1/1978 | Gray | 366/174 |
| 4,087,862 | 5/1978 | Tsien | 366/165 |
| 4,370,062 | 1/1983 | Moody | 366/336 |

FOREIGN PATENT DOCUMENTS

| | | | |
|---|---|---|---|
| 337921 | 12/1903 | France | 48/189.4 |
| 1532742 | of 1968 | France . | |
| 600937 | of 1978 | Switzerland . | |

OTHER PUBLICATIONS

Perry, Chemical Engineers Handbook, 4th Ed., McGraw Hill (1963), pp. 21-12/13.

Devellian "Motionless Mixers," *Automation,* (Feb. 1972).

*Primary Examiner*—Philip R. Coe

*Attorney, Agent, or Firm*—C. G. Nessler

[57] ABSTRACT

Disclosed is a liquid mixer having a multiplicity of slotted orifice plates spaced apart along the flow path within a chamber. Liquid passes through and exits from the slots at a 30–60 degree angle to the exit face of the orifice plates, thereby inducing turbulence which causes good mixing. Preferably the slots are radially disposed in circular orifice plates fitted closely within a cylindrical chamber. The radial length L of the slots is preferably five times the slot width T, and the spacing S of the orifice plates is 4–8 times the width. Straight slots are simplest to make but curved slots are preferred. Radial slots in a circular disc are preferred but other orientations are useful. When used for dispersing small volumes of water into oil, water is injected transversely into the oil upstream of the orifice plates, to cause initial droplet formation; and, the oil-water fluid velocity through the slots is kept in the range of 80–1600 feet per second.

10 Claims, 9 Drawing Figures

STATIC LINE MIXER

TECHNICAL FIELD

The present invention relates to in-line fluid mixers which have no moving parts, particularly to mixers for introducing a fine dispersion of water into oil.

BACKGROUND

It is often desired to intermix two fluids intimately, on a continuous basis. Such is the case when there is a primary fluid flowing through a pipeline, and it is desired to evenly disperse the second fluid into the first. Such intermixing is particularly difficult when there is very little mutual solubility between the fluids, e.g., such as exists with common petroleum oil and water.

Numerous devices to achieve intimate line mixing between two fluids have been known heretofore. Many line mixers are described in J. H. Perry, *Chemical Engineers Handbook,* Fourth Edition (1963), McGraw Hill Book Co., New York. One type is a jet mixer, wherein one of the liquids is pumped through a small nozzle or orifice into a flowing stream of other liquid. Such types of devices are generally only successful in liquids which have low interfacial tension, i.e., those that are miscible. Another type of mixer is one in which the liquids are flowed together simultaneously down a pipeline, and pass through a series of nozzles or orifice plates spaced apart along the pipeline. See for instance U.S. Pat. No. 3,856,270 to Hemker wherein a series of perforated plates having channels in their surfaces are placed in face to face contact within the fluid stream. Herbsman et al in U.S. Pat. No. 1,924,038 discloses an apparatus with a multiplicity of orifices and nozzles, to mix, divide, and induce a rotary motion in the fluid. Christenson et al in U.S. Pat. No. 2,802,648 discloses a combination of jet mixer and orifice plate mixer. After the fluids are intermixed, they are caused to flow downstream through a series of perforated plates mounted along a shaft.

Other mixers also are known, some of them quite elaborate, all with the goal of achieving good dispersions in a uniform manner. See for example U.S. Pat. No. 4,087,862 to Tsien and U.S. Pat. No. 3,582,365 to Lindsey. However, when mixing relatively crude or dirty materials it is a problem if a mixer is constructed of rather complicated passages, fragile passages, or very small passages. Such features create difficulty in obtaining uniform operating conditions, and can make the units difficult to maintain, and costly as well.

The present invention is particularly concerned with introducing and dispersing as very fine uniform droplets a small quantity of water into a flowing stream of petroleum oil, as described in my U.S. Pat. No. 4,335,737 for *Apparatus and Method of Mixing Immiscible Fluids.* In particular, the patented invention is aimed at dispersing small quantities of water in a fuel oil stream, becuase it has been found that doing such provides increased combustion efficiency and savings in energy costs. As is well known, the quantity of fuel which flows to a combustor can vary as a function of time. My related invention provides for the proper proportioning of the small quantity of water, according to the flow of fuel oil. But, to be effective, a line mixer, or emulsifier as it is called in my related application, must be capable of achieving good dispersion of the water at varying flow rates. In addition, the pressure drop through the mixer ought not to be so great as to necessitate exceptionally high pressures. Further, the mixer ought to be capable of operating with viscous liquids with substantial solid particulate content, as characterizes SAE No. 6 fuel oil. The prior art mixers are not well suited for this.

Another problem with many types of mixers in the prior art is that they require rather involved engineering calculations when the size of the unit is being changed. That is, if successful results are achieved in one size of mixer, the complexities of fluid dynamics must be taken into account if a larger or smaller unit is desired. Simple proportioning, as is well known to those skilled in fluid dynamics, will not often achieve the same results. Thus, since there is a desire that line mixers have different total flow capacities, it is desired that the design of a mixer be such that it is readily made to different scales.

DISCLOSURE OF THE INVENTION

An objective of the invention is to provide a simple and reliable mixer having no moving parts, wherein the mixer is especially adapted for introducing small quantities of water into oil and obtaining an emulsion thereof. A further object is to provide a mixer which is not prone to malfunction when small quantities of particulate are present in the fluid streams. A further object is to provide a mixer design which may be readily altered to provide different volumetric capacities.

According to the invention a mixer is comprised of a body having a chamber with a flow path for the flow therethrough of co-mingled fluids. Within the chamber are a multiplicity of spaced apart slotted orifice plates, perpendicular to the flow path. Preferably there are four circular flat plates and the slots are radially disposed in the plates. In each plate the slot passages are angled with respect to the longitudinal axis of the plate. Thus, the slots will discharge fluid at an angle, preferably 30–60 degrees, to the exit surface of the plate. The slot passages may be straight or curved, but most importantly the discharge of the fluid at an angle to the exit of the orifice plate provides the good mixing action. Each slot will have substantial length L compared to the width T of the slot passage. However, the slots cannot be made too small in width elsewise they are prone to plugging by particulate. Therefore, for oil and water the slots are 0.030–0.065 inch in width and the length L is at least two times, and preferably five times, the width. Desirably, the total cross sectional flow area of all the slots in any orifice plate is equal to the flow area of the pipe delivering fluid to the mixer, to minimize pressure losses in the mixer. The through plate length D of the slot is less critical, provided it is sufficient (nominally at least twice the width T) to establish stream line flow through the slot and to achieve the desired slot exit flow conditions.

For oil and water it is found that the flow velocity through the slots must be 80–1600 feet per second. Greater or lesser flow velocity results in poor emulsification, according to test data. The spacing between the adjacent orifice plates is important as well. Preferably the spacing S is 4–8 times the slot passage width. If too close, excessive pressure drop in the mixer results and the desired turbulence at the slot exit region is not obtained. Any number of plates beyond one can be used, but the number ought to be minimized to that necessary to first reach the desired dispersion. With oil and water, for example, it has been found that four plates are needed to obtain a good emulsion; but more than that does not produce additional benefit insofar as the mixture is concerned.

In a preferred embodiment the second fluid water is introduced into the first fluid oil upstream of the first orifice plate by means of an injection tube. The tube shape causes shearing of the water stream and high local turbulence. This creates an initial dispersion, thereby making the orifice plate action more effective. The desired injection mode is obtained by giving the water a velocity transverse to the oil velocity, and maintaining the water velocity at less than 7% of the oil velocity at that point.

The mixer is especially advantageous because simple change in the number or length of the slots can alter the capacity of a particular unit. Thus it is easy, for instance, to maintain the fluid velocity at the slots in the range of 80–1600 feet per second which has been found critical for a good oil and water emulsion. The use of slots in the orifice plates, compared to circular orifices or other passages of less effectiveness, means that the minimum number of orifice plates can be used. Thus the pressure drop incurred by fluids passing through the unit is minimized. The mixer is easy to construct and service.

These and other objects, features, and advantages of the invention will be understood further from the description which follows.

DESCRIPTION OF THE BEST MODE

The invention is described in the terms of the introduction of a second fluid, water, into a pipeline stream flow of a first fluid, oil. This will illustrate the use of the invention in the apparatus described in U.S. Pat. No. 4,335,737, the disclosure of which is hereby incorporated by reference. Nevertheless, it will be understood that the invention will be useful for many other fluids and applications.

Figure 1:
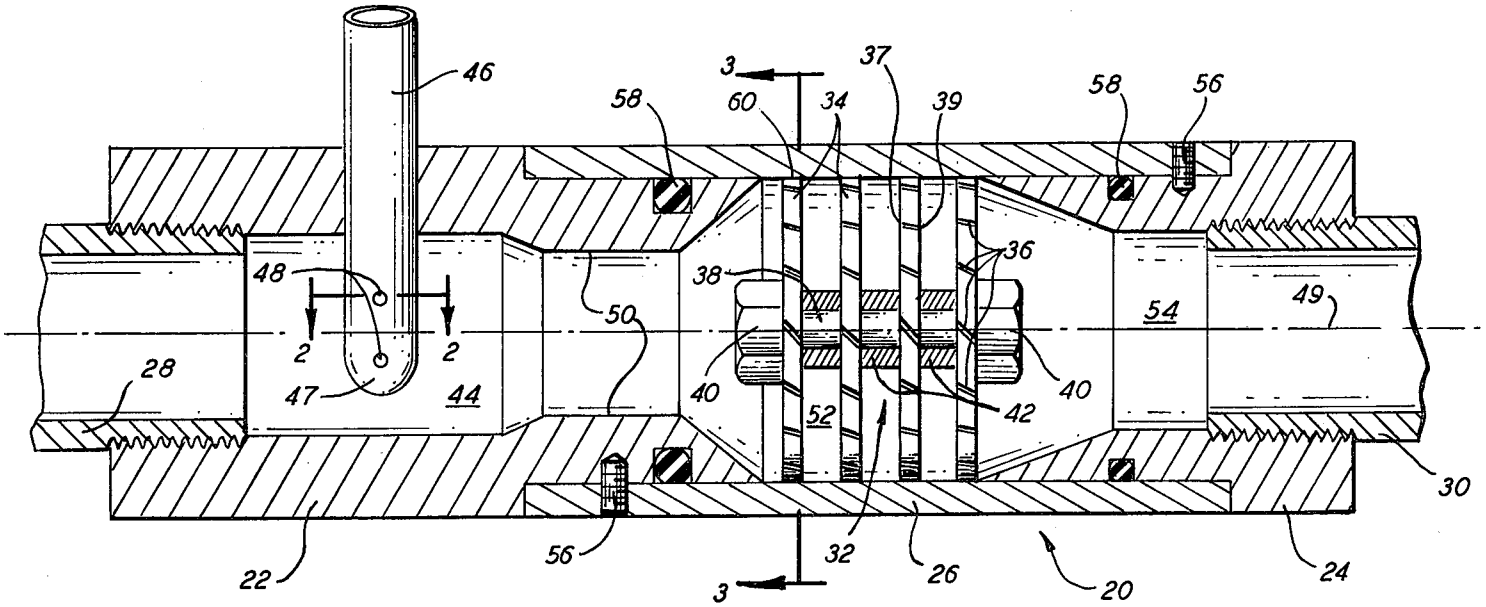
FIG. 1 is a longitudinal cross section of a circular shaped mixer of the present invention.

FIG. 1 shows in longitudinal cross section the inventive mixer 20 as it appears installed in a pipeline. The mixer 20 is made of metal and is comprised of an inlet end 22 and exit end 24, connected by a hollow cylinder central member 26. The mixer is connected at its ends to the pipeline 28,30, through which oil flows. Captured within central member 26, between the inlet and exit ends is an assembly 32 of spaced apart orifice plates 34. Each of the plates 34 is a disc having a multiplicity of angled slots 36, connecting the upstream disc face 37 with the downstream face 39, as described in more detail below. The discs 34 with cylindrical spacers 42, are mounted on a shaft 38, and they are retained on the shaft (which has threaded ends) by nuts 40.

Figure 2:
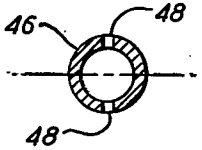
FIG. 2 is a cross section through the water injection tube of the mixer of FIG. 1 showing the discharge hole detail.

The inlet end 22 has a chamber 44, into which projects the second fluid injection tube 46. The end 47 of the tube 46 is closed. There are opposing discharge holes 48 along the length of the tube, where it projects into the chamber 44, as shown in the detail of FIG. 2. This enables fluid passing down the injection tube 46 to discharge into the chamber in a direction perpendicular to the longitudinal axis 49 of the mixer 20, to thereby provide a shearing action which causes initial disintegration of the water stream into droplets. The interior cavity of the inlet end 22 narrows to passage 50, and then expands to the diameter of the interior chamber 52 of the central member, where the assembly 32 of orifice plates is positioned. The exit end 24 is configured similarly to the entrance end, but does not contain any projecting injection tube; it serves similarly to provide communication of the chamber 52 with the downstream pipe 30. It is seen that the interior passage 54 of the exit end narrows down to the nominal inside diameter of the pipe 30. Set screws 56 join the central member 26 to the inlet and outlet ends, and prevent them from separating. 0-ring seals 58 prevent leakage where the ends join the central member.

Figure 4:
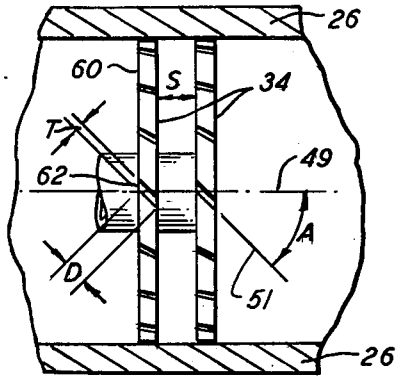
FIG. 4 is a more detailed longitudinal cross section fragment of a portion of the mixer in FIG. 1, showing details of the slot configuration in orifice plates.
Figure 3:
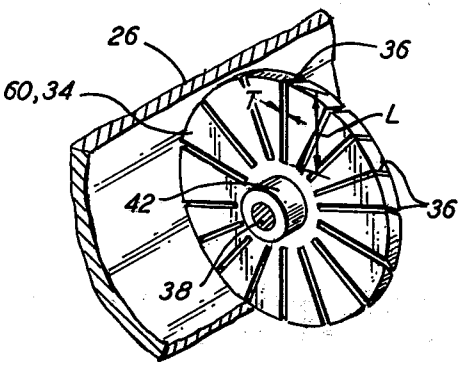
FIG. 3 is an axial section of the mixer shown in FIG. 1, illustrating a typical slotted orifice plate.

FIG. 3 shows an axial section through the mixer, just downstream of the first orifice plate 60. It is seen that the orifice plate has a multiplicity of slots, radially disposed around its periphery. FIG. 4 is a more detailed fragment of the longitudinal cross section of the central portion of the mixer shown in FIG. 1, and when considered in conjunction with FIG. 3 will lead to an understanding of the particular nature and importance of the slots which characterize the orifice plates. In the disc 60 shown in FIG. 3 the orifice plate has 16 equally spaced apart slots 36, which I have found to be most satisfactory. Each slot is characterized by a length L. The length is somewhat arbitrary and may vary, but usually it is made as long as possible without structurally weakening the orifice plate. FIG. 4 shows an end view of a slot 62 which lies along a radial which is normal to the plane of the paper. The slot has a width T and a through-plate length D, hereinafter characterized as depth. The slot D-length axis 51 is at an angle A to the longitudinal axis 49 of the mixer, which corresponds with the longitudinal axis of the disc. The orifice plate discs are spaced apart from each other a distance S, where S is the distance between the downstream side of a first disc, and the upstream face of the next disc.

It should be appreciated that the fluid oil introduced from the entrance pipe 28 will flow at a first velocity through chamber 44, then increase in velocity through the passage 50, and then slow again as it enters the main chamber 52. The constriction 50 in flow area is for construction convenience of the particular design shown, and is not essential. When the oil flows past the water injection tube 46, water under a pressure greater than that of the oil in the chamber 44 is flowed through the holes 48, whereupon it first mixes with the oil, as large droplets. The holes 48 are sized so that the velocity of the water is relatively low. For instance four holes of 0.081 inch diameter are suited for 6–60 gallons per hour (gph) of water into 60–600 (gph) of oil flow. The nominal water velocity ranges between 1.5 to 15 feet per second (fps) and is about seven percent of the nominal velocity of the oil in the chamber 44. The water should have the foregoing low velocity as it exits from the holes 48, so that it is easily entrained by and first mixed with the oil, without flowing rapidly toward the periphery of the chamber 44. The holes 48 are placed perpendicular to the flow line of the oil, and the longitudinal axis 49 of the mixer, to promote a relative shear action of the oil on the water, and to avoid a blockage of the holes by any foreign particles which may be flowing along with the oil.

The circular cross section of the tube 46 is designed to cause high turbulence immediately downstream of the tube. This desirably causes some initial mixing of the water within the oil, but for most applications this is entirely insufficient. When the mixture flows into central chamber 52, it is forced to flow through the slots 36 of the first orifice plate 34, 60. Since the slots 36 are angled with respect to the longitudinal axis and the overall flow direction of the oil, the oil is turned to flow at an angle to the axis 49 and assumes a rotational swirling type motion, as it exits from the first orifice plate. It continues flowing axially downstream, where it encounters the second orifice plate, and thereafter the third and fourth orifice plate. At each the stream is divided and recombined, as it is forced to pass through the multiplicity of passages. Finally, the oil and water mixture, which will ordinarily be now found to be an emulsion through the action of the mixer, will exit through the passage 54 and proceed down the exit pipe 30.

Figure 5:
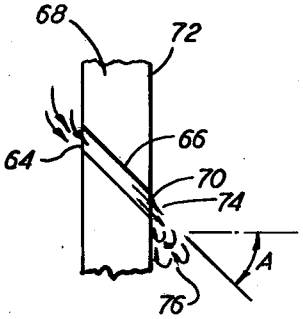
FIG. 5 is a more detailed view of an orifice plate like those shown in FIG. 4, illustrating how fluid flows through the slots.

FIG. 5 shows how the oil water mixture flows through a typical orifice plate slot, and how the slot aids in mixing. Upstream of the plate the oil is flowing in a generally swirling pattern, as it approaches the entrance 64 of a slot 66 in a disc 68. The mixture passes through the slot, and at the slot exit side 70 it is moving at an angle to the downstream face 72 of the orifice, as represented by lines 74. At the exit face where the angle between the discharge flow lines 74 and the face 72 is acute, there is great turbulence generated, represented by curved lines 76. This turbulence is believed to operatively cause dispersion of the water within the oil, by breaking the water droplets into finer and finer particles, and ultimately causing what may be characterized as an emulsion. The invention is only effective if the angle A is appreciable. That is, slots which are normal to the exit surface (A=zero) are not effective in establishing the desired turbulent flow. Obviously, if A is made too great (approaching 90 degrees) then my device would not be functional, because the slot depth would be too great, the part would be very difficult to make, and there would be very few slots permitted in any given disc. Preferably, in the practice of my invention A is between 30–60 degrees; I have found that 45 degrees is most satisfactory.

Figure 6:
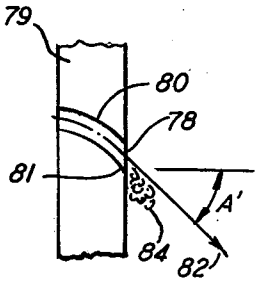
FIG. 6 is similar to FIG. 5 but shows a curved slot passage.

The slots may be placed in my orifice plates by conventional machining techniques, such as by sawing. Since I have identified the creation of the turbulent flow conditions at the exit of the slot to be important, the configuration of the disc fragment 79 shown in FIG. 6 would be an even better embodiment of the invention, but for the fact that it is more difficult to machine. As indicated in FIG. 6, the discharge end 78 of the slot 80 would be a curved passage, resulting in a nominal discharge angle A′ for the stream flowline 82; the flowline being essentially tangent to the slot passage curve at the exit. As will be understood by those with skill in fluid dynamics, strong turbulence 84 will be created at the upstream side 81 of the curved passageway. Thus, the curved slot design can enable fewer orifice plates to be used when a certain dispersion is sought, thereby lowering the pressure drop through the entire mixer.

From my work with heavy oil I have found that the disc spacing dimension S should be at least about twice the thickness of a 0.125 disc, and at least about 0.250 inch. If it is too small then excess pressure drop will be caused and the turbulent action at the slot exit may be inadequate to get good dispersion. If it is large the mixer will function acceptably but it becomes unnecessarily long. As will be appreciated with further discussion herein, the spacing S is also related to the width T of the slot, and it ought to be greater than 4 times the slot width, preferably 4–8 times.

As shown in the Figures, preferably each orifice plate has slots angled to impart a circumferential velocity component to the fluid in the same sense. Alternate circumferential flow-reversing may be used but with greater pressure drop and somewhat decreased effectiveness when the spacing dimension S is small. The slot width T may vary. Preferably it is small, at about 0.060 inch or less. Relatively small slots of about 0.030 inch width are usable, but only for fluid streams where there is an absence of particulates which may block the passage.

Slots are particularly advantageous compared to other orifice shapes, such as circular holes. They provide relatively high ratio of peripheral edge area to cross sectional flow area, thereby increasing the region at which the turbulence takes place and decreasing the number of stages to achieve a desired dispersion. In addition the capacity of a unit, or of different units, may be varied easily by changing the slots' lengths L. The dimension L may be increased or decreased with assurance that satisfactory results will be achieved without fluid dynamic scaling problems of consequence. Since the phenomena occuring at the upstream side of the exit end of the slots has been identified as being important, it is desirable that the slot cross section aspect ratio, L/T, be maintained at a relatively high value, about 5:1 for efficient performance of a particular orifice plate.

I have discovered important relationships for the slot area when dispersing water in heavy fuel oil. Referring again to FIG. 3, the slot flow area in aggregate for any disc is nominally equal to the number of slots multiplied by the length L and the slot width T. Preferably, the aggregate slot area of a disc will be about equal to the cross sectional flow area of the inlet pipe 28. With this relationship and with 300 SSU heavy oil, into which is introduced five volume percent water, a pressure drop of about 2 psig over each disc will result when the mixer is used to process 540 gph of oil. For four plates in a mixer, this represents an acceptable pressure drop in the typical oil pipeline which feeds a combustor.

Figure 7:
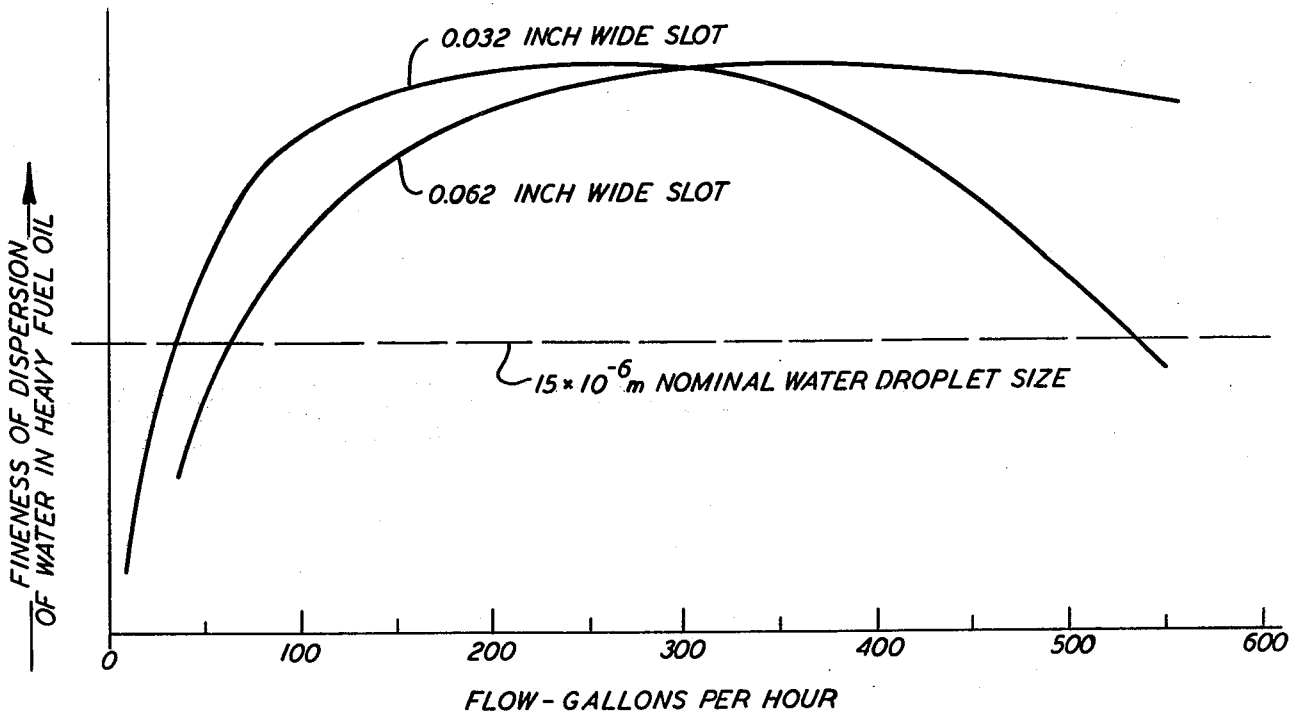
FIG. 7 shows how the quality of emulsification varies with the flow rate through a mixer like that shown in FIG. 1.

For a mixer like that shown in FIG. 1, where each two inch diameter by 0.125 inch thick disc has sixteen slots of about 0.5 inch length and width between 0.030–0.065 inch, and where the angle A is about 45 degrees, the velocity through the slots is critical, as illustrated by FIG. 7. The emulsion which results can be examined by means of a microscope. A satisfactory emulsion should have a bulk of the droplets at less than $15\times10^{-6}$m, with the average around $7\times10^{-6}$m. As indicated in FIG. 7, for the apparatus with 0.032 inch wide slots, when the flow drops below 30 gph, or exceeds 600 gph, the fineness of the dispersion decreases unacceptably. In the first instance, the velocity through the device, and the slots in particular is probably too low to cause sufficient turbulence. At the higher flow rate, about 600 gph, it appears that different flow conditions are obtained, and the quality of the dispersion drops again. At the higher flow rate the pressure drop over all the four plates is about 8 psig.

In contrast, the performance of the 0.062 inch slotted orifices is such that when the flow drops below about 60 gallons per hour, the dispersion becomes unacceptable. The upper limit was not able to be measured, but it is my conclusion from experiments that at a flow of 1200–1600 gph the quality of dispersion will again drop. At about 600 gph the pressure drop with the 0.062 inch slots is appreciably less at about 4–5 psig. This is understandable since the flow area of the totality of slots is approximately double that of the 0.032 inch wide slotted discs. From the foregoing it can be calculated that the fluid velocity through the slots is critical and should be at least 80 feet per second (fps) and less than 1600 fps.

My basic work was performed on mixers which contained four orifice plates through which the fluid passed sequentially. With lesser numbers, a dispersion inadequate for my purposes was created. However, lesser number of plates, even a single plate, may be satisfactory in other applications. For greater than four plates, up to eight, the improvement in dispersion for the water-oil mix did not warrant the increased pressure drop. However, in liquids where dispersion is more difficult, additional plates may be used beyond the four I found satisfactory.

Figure 9:
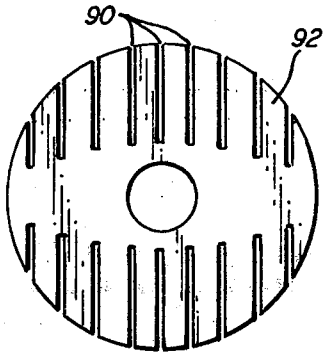
FIGS. 8 and 9 show other embodiments of slotted orifice plates.
Figure 8:
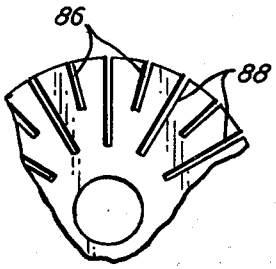

Other configurations of slotted orifice plates are within the scope of the invention, including but not limited to, the configurations shown in FIGS. 8 and 9. In FIG. 8 it is seen that smaller shorter length slots 86 may be interspersed between the longer radial slots 88. (As in all the preferred orifice plates in my mixer, the slots have identical width. However, smaller slots or other holes may be placed on any orifice plate without adversely affecting the performance of my basic invention.) In FIG. 9, the slots 90 are arrayed parallel to a particular diameter of the orifice plate 92; this may simplify manufacture. And of course, there is no limitation on the exterior configuration of the orifice plates of my invention; they may be square, rectangular, etc. Other variations in the details of construction will be within the scope of the broader embodiments of the invention. While the mixer has been described above in terms of a body comprised of three separate elements, end 22, end 24, and central member 26, it should be evident that this configuration is but one which is convenient for construction and maintenance. Generally, the mixer is comprised of a body having an internal passage through which the second fluid flows, and wherein are placed the orifice plates. Similarly, the manner in which the orifice plates are spaced apart may be varied. For example, cylindrical spacers fitting the bore at chamber 52, at the outer diameter of the plates may be used; steps, projections, etc., in the bore chamber 52 also may be used.

Generally, the in-line construction of the mixer is preferred. But the inlet and outlet need not be coaligned; they may be offset or angled. Also, the injection tube may be located apart from the other body interior parts of the mixer. Or, in the case of two fluids which are presented already intermixed, but not fully dispersed, the mixer may be used without the injection tube at all.

While the invention has been described in the foregoing preferred embodiment and alternatives, it should not be so limited, as it is capable of many modifications, and changes in construction may be made without departing from the spirit and scope of the invention.

I claim:

1. A liquid mixer for dispersing a second fluid into a first fluid comprised of a body having a chamber with a longitudinal axis, the chamber having a flow path for the flow of a comingled first fluid and second fluid therethrough along said axis; a plurality of orifice plates spaced apart along said axis and fixedly held within the chamber; each orifice plate having an upstream face, a downstream face and a multiplicity of slot passages connecting the faces; each slot passage having a length L and a through-plate length D, both lengths at least two times the width T of the slot passages; and each slot passage shaped to discharge fluid at an angle of 30–60 degrees to the downstream face of the orifice plate.

2. The mixer of claim 1 further comprising an injection tube projecting into the chamber perpendicular to the longitudinal axis thereof, for introducing the second fluid into the first fluid, the tube having a plurality of second fluid discharge orifice positioned to discharge second fluid in a direction normal to the longitudinal axis of the chamber.

3. The mixer of claims 1 or 2 adapted for mixing water into oil, characterized by orifice plates having slots with widths T of 0.030–0.065 inch and lengths L at least five times the slot width.

4. The mixer of claim 2 characterized by four orifice plates.

5. The mixer of claim 1 or 2 characterized by a body having connected inlet and outlet pipes for delivering to and receiving fluid from the chamber and by each orifice plate containing slots having a total flow area about equal to the cross sectional area of the inlet pipe.

6. The mixer of claim 1 characterized by a circular chamber and circular orifice plates having radial slots.

7. The mixer of claim 1 characterized by orifice plates having slot passages with uniform widths T, the plates spaced apart a distance S of 4–8 times the width T.

8. The method of dispersing water into oil which comprises introducing water into a stream flow of oil to form an intermixed fluid; causing the intermixed fluid to pass sequentially through a plurality of orifices plates having slot passages with lengths L and through-plate lengths D, both at least twice the slot width T; discharging the intermixed fluids from each orifices plate slot at an angle of 30–60 degrees to the exit surface of the orifices plate with a velocity of 80–1600 feet per second, to thereby induce turbulence in the intermixed fluid and cause dispersion of the water into the oil stream.

9. The method of claim 8 characterized by introducing the second fluid into the first by discharging it transversely to the stream flow line of the first fluid upstream of the orifice plates using means which causes turbulence, to thereby create a first dispersion.

10. The method of claim 8 which further comprises injecting water into the oil to form the intermixed fluid by discharging the water from small orifices in a direction transverse to the stream flow of oil, wherein the water has a velocity which is about seven percent of the velocity of the oil passing by the orifices.

* * * * *